United States Patent [19]

Bianchi

[11] 4,140,434

[45] Feb. 20, 1979

[54] FEATHERING PROPELLER ESPECIALLY FOR SAILING BOATS

[76] Inventor: Massimiliano Bianchi, Via Molo Vecchio, 26, Gravedona( Como), Italy

[21] Appl. No.: 748,256

[22] Filed: Dec. 6, 1976

[51] Int. Cl.[2] ..... B63H 1/24

[52] U.S. Cl. ..... 416/140; 416/212 R; 416/142

[58] Field of Search ..... 416/140, 142, 245 A, 416/208, 212

[56] References Cited

U.S. PATENT DOCUMENTS

| | | | |
|---|---|---|---|
| 1,520,746 | 12/1924 | Boyce et al. | 416/140 |
| 1,718,525 | 6/1929 | Casey | 416/140 |
| 2,134,157 | 10/1938 | Thompson | 416/140 |
| 2,231,464 | 2/1941 | Dubbs | 416/245 A X |
| 2,279,633 | 4/1942 | Merickle | 416/208 X |
| 2,283,774 | 5/1942 | Thompson | 416/140 |
| 2,477,944 | 8/1949 | Rouse | 416/140 |
| 2,593,290 | 4/1952 | Gansert | 416/140 X |
| 3,204,702 | 9/1965 | Brown | 416/140 X |
| 3,282,351 | 11/1966 | Troutman | 416/140 X |
| 3,308,889 | 3/1967 | Langhjelm et al. | 416/140 |
| 3,403,735 | 1/1968 | Langhjelm et al. | 416/140 |
| 3,567,336 | 3/1971 | Bartha | 416/140 X |
| 3,709,634 | 1/1973 | Lorenz | 416/140 X |
| 4,047,841 | 9/1977 | Laurin | 416/140 |

FOREIGN PATENT DOCUMENTS

| | | | |
|---|---|---|---|
| 2026078 | 9/1970 | France | 416/140 |

*Primary Examiner*—Everette A. Powell, Jr.

*Attorney, Agent, or Firm*—Guido Modiano; Albert Josif

[57] ABSTRACT

Feathering propeller particularly for auxiliary engines of sailing boats. The propeller comprises a device for transmitting a rotary and a positioning motion to the blades including planetary gear means for converting an angular motion of the drive shaft into an angular motion for inclining the propeller blades and means for halting the angular motion to halt the blades at the required inclination and render the blades of such inclination rigid both with the relative hub and with the drive shaft.

1 Claim, 4 Drawing Figures

FEATHERING PROPELLER ESPECIALLY FOR SAILING BOATS

BACKGROUND OF THE INVENTION

This invention relates to a feathering propeller, and more particularly to a feathering propeller for auxiliary engines of sailing boats.

As is well known to all those concerned with sailing, the engine, and the propeller driven by it, are used only exceptionally, for example for manoeuvres in ports or in cases of emergency, and they are required to disturb running under sail as little as possible. In particular, the propeller must offer the minimum possible resistance to the water when not in use, while remaining in position and touched by the relative water current. Three types of propellers are used at present, namely:

fixed closable (or beak type), and feathering.

The fixed propeller offers high hydrodynamic resistance because of the fierce vortices which it creates in the water.

The closable propeller however offers a much smaller resistance because it does not create vortices when the blades are closed.

This type of propeller is the type most frequently used at present. However, reversing with this propeller is difficult and inefficient.

The feathering propeller is the least used at present, because the embodiments constructed up to the present time have two main disadvantages:

(a) they create vortices in the water due to the curvature of the blade surfaces, even when the blades are feathered.

(b) they are mechanically complicated (they often comprise pitch variation controls inside the drive shaft).

In calculating the rating, account is taken of the hydrodynamic resistance offered by these three types of propeller by attributing three different coefficients to them. The rating is notably a decisive factor in the chances of victory of a sailing boat in a regatta. A favourable rating therefore considerably increases the value of the boat itself.

The rating coefficient for the feathering propeller is more favourable than that for the closable propeller, because the rules have been drawn up in such a manner as to compensate for the disadvantages of the present feathering propellers described heretofore (points a and b).

SUMMARY OF THE INVENTION

Consequently one object of the invention is a propeller of the stated type which offers a minimum resistance in water to sailing, while possessing a favourable rating in a regatta.

A further object is a propeller of good efficiency both in forward and reverse running.

A further object of the invention is a simple automatic device for arranging the propeller for forward or reverse running, based on the direction of rotation of the engine.

A further object is a device which facilitates setting of the propeller pitch.

These and further objects which will be evident hereinafter are attained by a feathering propeller especially for sailing boats according to the invention, characterized in that it comprises a device for transmitting the blade rotary and positioning motion which comprises planetary means for converting the rotary motion of the drive shaft into motion for inclining the propeller blades, and means for halting the inclining motion to halt the blades at the required inclination and render the blades of such inclination rigid both with the relative hub and with the drive shaft.

BRIEF DESCRIPTION OF THE DRAWINGS

The characteristics, mode of operation and advantages of the invention will be more evident from the detailed and full description of its preferred embodiments, given by way of non-limiting example with reference to the accompanying drawing, in which.

DESCRIPTION OF THE PREFERRED EMBODIMENTS

Figure 1:
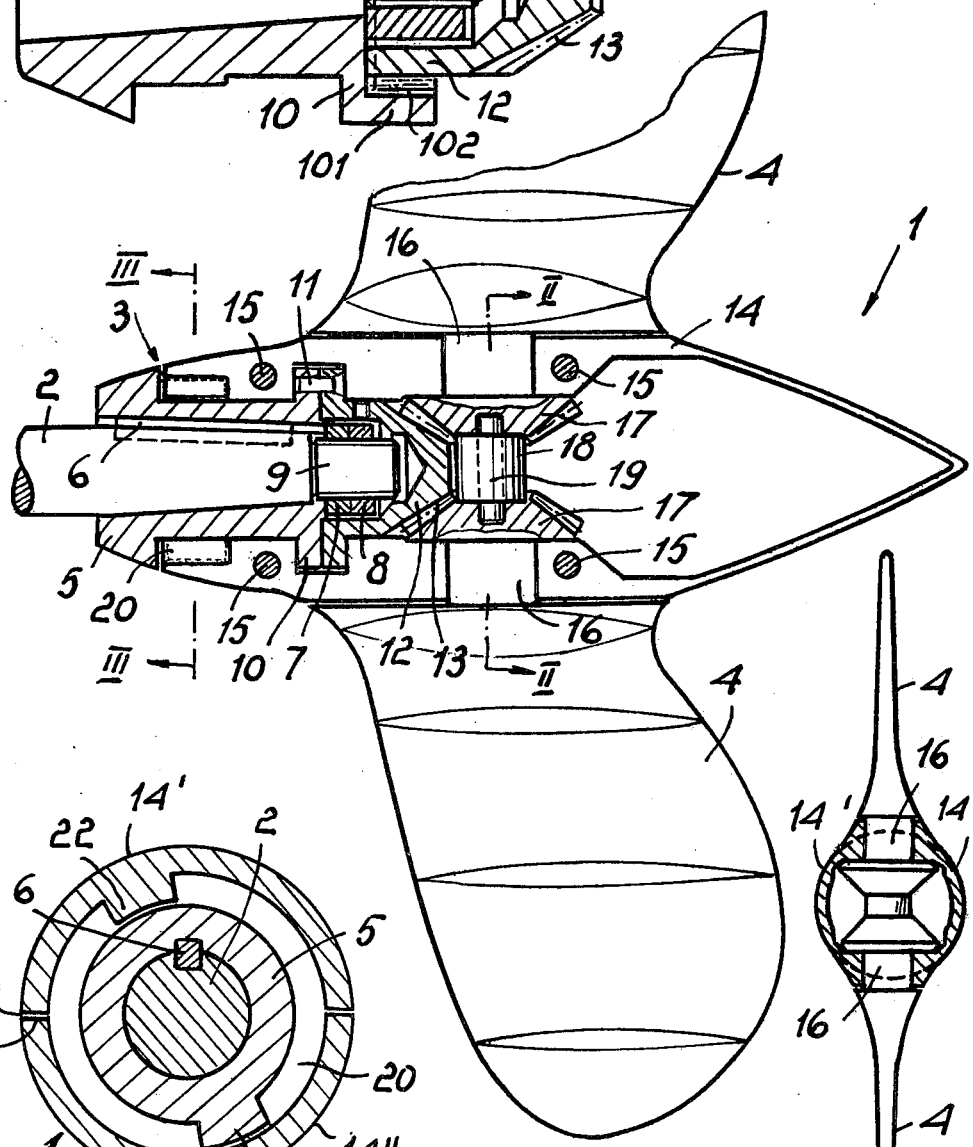
FIG. 1 is a longitudinal view of a first embodiment of a propeller assembly according to the invention taken in the plane of the feathering blades, with the hub axially sectioned.
Figure 3:
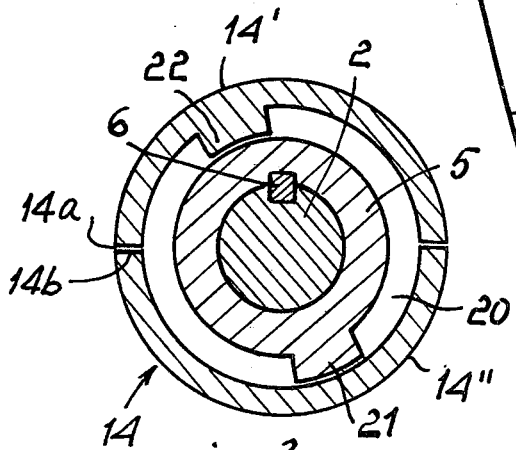
FIG. 3 is a section on the line III—III of FIG. 1.
Figure 2:
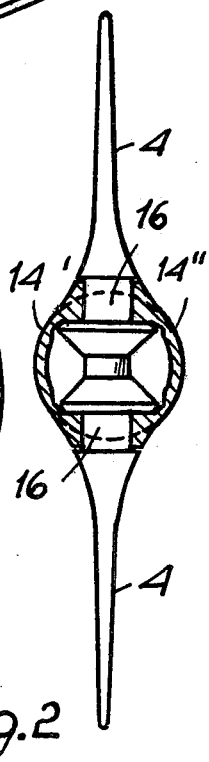
FIG. 2 is a transverse view of the same assembly to a reduced scale, with the hub sectioned on the line II—II of FIG. 1.

Although particular reference is firstly made to FIG. 1, the three FIGS. 1 to 3 should be observed together because only in this manner can a complete representation of the invention be obtained.

A complete propeller assembly is indicated overall by the reference numeral 1, and comprises essentially a drive shaft 2, a hub assembly 3 and two blades 4 and 4. The hub assembly 3 is connected to the drive shaft 2 by way of a flanged sleeve 5 locked on to the shaft by a key 6 and ring nuts or nuts 7 and 8 screwed on to the threaded end 9 of the shaft 2. A cap 12 is connected to a flange 10 of the sleeve 5 by bolts or screws 11, and incorporates at its front a planetary bevel gear or pinion 13. The actual hub of the propeller 14 is in the form of two shells 14' and 14" joined together by screws 15 extending transverse to the longitudinal extension of the hub to form an enclosure enclosing internally the sleeve 5 and cap 12 with the pinion 13, on which the hub is rotatable within limits. As clearly visible from FIGS. 1 and 3 of the drawing the two shell-halves 14' and 14" have their mutually engaging edges **14*a* and 14*b* extending according to a longitudinal plane of symmetry of the assembly, i.e. the hub 14 is divided according to such longitudinal plane of symmetry to form the two shell-halves, which have an elongated ogivelike shape. The two blades 4 are inserted into the hub 14 each by way of a blade shaft 16 rigid with its blade. On the end of each blade shaft 16 inside the hub there is keyed a planetary bevel gear or pinion 17, located inside the hub 14 and engaging with the pinion 13 rigid with the drive shaft 2 through the sleeve 5 on which it is fixed. The two planetary pinions 17 oppose each other and face each other axially, the two shafts 16 being held between the two shells 14' and 14" of the hub. To prevent slack and keep the two opposing pinions 17 spaced apart and aligned, a spacing cylinder 18 with an axial pin 19 is idly mounted between the two pinions and in contact therewith. The angle through which the blades can rotate rigid with the respective pinions is limited in order to define the working inclination of the blades when the propeller rotates. In the example of the drawing, the limitation on blade rotation is obtained by a stop abutment which limits the rotation of the hub 14 relative to the sleeve 5 rigid with the drive shaft 2. The stop abutment is formed in an annular cavity 20 provided on the marginal edge of the hub 14 which surrounds the flanged sleeve 5. An external stop tooth 21 projects from the sleeve 5 and an internal stop tooth projects from the hub 14**. The two positions of engagement of the two teeth prevent further rotation of the hub relative to the drive shaft in one direction and the other, and define the two inclined positions of the blades, namely that for forward running and that for reverse running, as will be explained hereinafter.

The same stop condition could be obtained without deviating from the invention by providing for example stop blocks on the teeth of the pinions 17, at an angle corresponding to the required blade inclination. However the design shown on the drawing offers the advantage of more easy setting of the optimum blade positions by making one of the stop teeth thicker or thinner, or by making one of the two teeth insertable and fixable by screws so that it may be changed or moved. This design also has the advantage of removing the blade inclination gears from the action of the drive torque, which is transmitted by the stop teeth directly to the hub. The feathering propeller assembly described operates in the following manner. When the boat or craft is under sail with the engine at rest, the shaft 2 remains idle and, because of the dynamic resistance of the water, the blades are brought automatically into the feathered position, i.e. the position of least resistance shown in FIGS. 1 and 2, and there is no danger of them accidentally assuming another position because of the mutual gear engagement of the two blades, there being therefore no need to provide or operate any control or clutch.

In the feathered position the stop teeth 21, 22 are spaced apart.

If at a certain moment the engine is started, it rotates the drive shaft 2. The feathered propeller offers maximum resistance to rotation, and therefore does not immediately follow the shaft, and the shaft and sleeve therefore rotate relative to the hub, so that the drive pinion 13 drives the two planetary pinions 17 in such a manner that the two blades incline at the same angle of inclination to the plane normal to the axis. This blade rotation increases until the tooth 21 strikes against the stop tooth 22. Relative movement between the hub and shaft then ceases because of this state of abutment, and the propeller is driven by the shaft at the inclination which it had attained at the moment in which the two teeth came into contact. The arrangement is such that, starting from the feathered position which is considered the zero position, the abutment is encountered by the tooth 21 after an angle of relative rotation corresponding to a precise predetermined angle of inclination of the blades. As the shaft can rotate in two directions, there are two distinct angles of relative rotation before reaching the state of abutment, and consequently two possible distinct automatic angles of inclination of the blades. These angles are made to correspond to the normal angles of blade inclination for forward running and reverse running. The setting may be calculated in an obvious manner, starting from the two required angles of blade inclination and the ratio of the number of teeth on the drive pinion to the number of teeth on the planetary pinion, to give the theoretical angle of abutment in the two directions of rotation.

Figure 4:
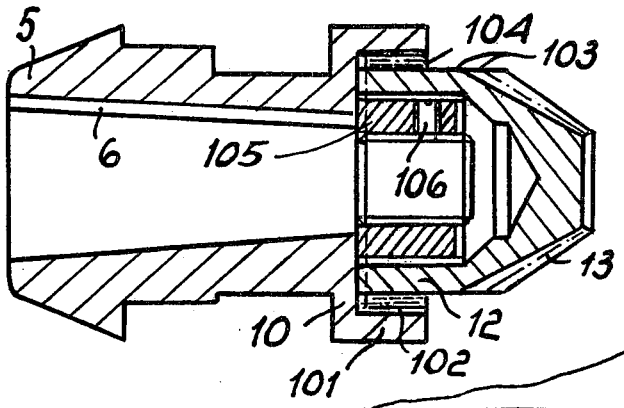
FIG. 4 is an enlarged detail of FIG. 1 modified in accordance with a second embodiment.

In a second improved embodiment of the invention shown in FIG. 4, the sleeve 5, fixed on to the shaft 2 by the key 6, and the cap 12 rigid with the pinion 13 are coupled by a straight toothed gear coupling.

For this purpose, the sleeve comprises a flange 10 from which a collar or ring 101 projects, on the inner periphery of which there being provided straight internal toothing 102. The cap 12 correspondingly carries on the outer periphery of its cylindrical surface 103 toothing 104 which engages with the toothing 102. The sleeve 5 is kept tight on the shaft 2 by a nut 105 locked by a dowel 106. The cap 12 is kept engaged by its toothing 104 in the toothing 102 by the two shells of the hub enclosure 14 which holds the whole assembly together and which contains in the groove 20 a stop abutment for a tooth on the sleeve 5. The enclosure 14 is at a fixed angular position relative to the axis of the planetary gears 17.

The operation of the device is as follows.

To vary the working pitch of the propeller, the two shells of the hub enclosure 14 are removed, the cap 12 is disengaged while being held rigid with the blades 4 and the intermediate gears, and is re-engaged in a different angular position, compatible with the pitch of the toothing.

This gives only a rough setting, as it is not practical to make teeth of very small pitch. To obtain a finer setting, use is made of the combination of this new modification and a fundamental characteristic of the invention, namely planetary transmission. To change the angular position of the blades relative to the shaft, the cap is withdrawn from its engagement in the sleeve 5, it is then disengaged from the planetary gears 17 and, without moving these latter, is re-engaged therewith in a different angular position, i.e. offset by one or more teeth. With different combinations of the two relative engagement rotations described, a very fine differential graduation may be obtained providing the number of teeth on the toothing 102 is different from the number of teeth on the toothing 13. If for example there are 21 teeth on 102 and 20 teeth on the pinion 13, by displacing the coupling in the reverse direction by one tooth, the propeller control may be phase displaced by approximately 18° − 17° = 1°.

It is apparent that by suitably choosing the number of teeth, adjustment may be made as gradual as required within the entire usable range of 0° to 90° of inclination of the propeller blades.

The proposed object of avoiding controlled or possibly automated couplings with mechanical connections on the drive shaft for reversing the running of the propeller or for the feathering thereof, is very simply and immediately attained. The efficiency of the propeller is very good, both in forward and reverse running. The very simple compact construction of the pinion device for automatically positioning the blades enables the dimensions of the hub to be reduced relative to previous designs, and to give a very flat propeller assembly with a further reduced hydrodynamic resistance, in accordance with the fundamental requirement for this type of propeller.

The improved device of the second described embodiment also enables the blades to assume any limit position through an arc of 360°. Thus any pitch value may be obtained by a simple setting operation. The same propeller may be either right handed or left handed, and either pushing or pulling, thus giving complete universality.

The invention is susceptible to modifications of shape, particulars or details, without leaving its scope of protection as defined by the aforegoing characteristics, and repeated in the claims given hereinafter.

While reference has been made to sailing boats the propeller of the invention may be usefully employed in any type of water vehicle.

I claim:

1. A feathering propeller for sailing boats, comprising an axially extending hub, a plurality of propeller blades journalled by said hub on axes each in a plane radial to the hub to permit rotation of each blade to vary its pitch angle with respect to the feathering position of the blades, a sleeve member disposed coaxially within and journalled rotatably within limits by said hub for receiving therein an end portion of a powershaft and means for connecting said sleeve member with said power shaft, a bevel gear rotatable with each blade, a planetary bevel gear pinion rotatable with said sleeve member and meshing in common with said blade gears arranged in planetary relationship therewith and wherein said planetary bevel gear pinion has a cylindrical extension having a spur gear toothing coaxial therewith and said sleeve member has an axial extension with a straight internal toothing coaxial with said spoor gear toothing and meshing therewith and wherein said hub has an inner annular recess facing the outer periphery of said sleeve member to define an annular cavity therebetween, a first stop formation freely projecting from said hub into said annular cavity and a second stop formation freely projecting from said sleeve into said cavity and arranged in the same circumferential plane as the first stop formation, thereby to allow a maximum relative angular movement in either direction between said sleeve member and said hub over an angle determined by the abutment positions of said first stop formation against said second stop formation, the common mesh between said planetary bevel gear pinion and said blade gears allowing in disassembled condition a first adjustment of the bevel gear pinion relative to the blade gears in either directions and the mesh between said straight toothing and said spur gear allowing in disassembled condition a differential angular adjustment in either direction of said sleeve member relative to said blade gears the number of teeth of said spur gear being different from the number of teeth of said bevel gear pinion.

* * * * *

UNITED STATES PATENT OFFICE

CERTIFICATE OF CORRECTION

Patent No. 4,140,434 Dated February 20, 1979

Inventor(s) Massimiliano BIANCHI

It is certified that error appears in the above-identified patent and that said Letters Patent are hereby corrected as shown below:

On the face page between item No. 22 and No. 51 insert the following item to read as follows:

[30] Foreign Applications Priority Data

Dec. 29, 1975 [IT] Italy..... 30819 A/75

May 25, 1976 [IT] Italy..... 23598 A/76

Signed and Sealed this

*Seventeenth* Day of *June 1980*

[SEAL]

*Attest:*

SIDNEY A. DIAMOND

*Attesting Officer* *Commissioner of Patents and Trademarks*